US011434909B2

(12) United States Patent
Lee et al.

(10) Patent No.: US 11,434,909 B2
(45) Date of Patent: Sep. 6, 2022

(54) COMPRESSOR APPARATUS AND MANUFACTURING METHOD OF THE SAME

(71) Applicant: LG Electronics Inc., Seoul (KR)

(72) Inventors: Kangwook Lee, Seoul (KR); Jungsun Choi, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 33 days.

(21) Appl. No.: 17/260,098

(22) PCT Filed: Jul. 12, 2019

(86) PCT No.: PCT/KR2019/008631
§ 371 (c)(1),
(2) Date: Jan. 13, 2021

(87) PCT Pub. No.: WO2020/013652
PCT Pub. Date: Jan. 16, 2020

(65) Prior Publication Data

US 2021/0277897 A1 Sep. 9, 2021

(30) Foreign Application Priority Data

Jul. 13, 2018 (KR) ..... 10-2018-0081773

(51) Int. Cl.
*F04C 18/02* (2006.01)

(52) U.S. Cl.
CPC ..... *F04C 18/0215* (2013.01); *F04C 2230/60* (2013.01); *F04C 2230/603* (2013.01); *F04C 2240/30* (2013.01); *F04C 2240/805* (2013.01)

(58) Field of Classification Search
CPC ..... F04C 2230/60; F04C 2230/602; F04C 2230/603; F04C 2230/604;
(Continued)

(56) References Cited

U.S. PATENT DOCUMENTS 7,163,383 B2 1/2007 Skinner
2007/0201996 A1* 8/2007 Gopinathan ..... F04C 23/008 418/55.1

(Continued)

FOREIGN PATENT DOCUMENTS

JP 3551647 8/2004
JP 2007077850 3/2007

(Continued)

OTHER PUBLICATIONS

PCT International Search Report and Written Opinion in International Appln. No. PCT/KR2019/008631, dated Oct. 30, 2019, 10 pages (English translation only).

*Primary Examiner* — Mark A Laurenzi
*Assistant Examiner* — Xiaoting Hu
(74) *Attorney, Agent, or Firm* — Fish & Richardson P.C.

(57) ABSTRACT

Provided is a compressor apparatus comprising: a casing defining appearance of the apparatus; and a drive portion coupled to an inner circumferential surface of the casing and configured to rotate a rotatable shaft; a compression portion coupled to the rotatable shaft and configured to compress fluid, wherein the compression portion apparatus is characterized in that the drive portion and the compression portion are fixed to the fastening member which is detachably attached to at least one of the side face of the drive portion or the side face of the compression portion and thus, the combination of the drive portion and the compression portion is coupled to an inner circumferential surface of the casing. Further, provided is a manufacturing method of the compression portion apparatus.

20 Claims, 8 Drawing Sheets

(58) Field of Classification Search
CPC ..... F04C 18/00–565; F04C 2240/30; F04C 2240/805
See application file for complete search history.

(56) References Cited

U.S. PATENT DOCUMENTS

| | | | | |
|---|---|---|---|---|
| 2013/0216415 | A1* | 8/2013 | Cho | F04C 18/00 418/55.1 |
| 2013/0251543 | A1* | 9/2013 | Duppert | F04C 23/008 417/410.5 |
| 2015/0192129 | A1* | 7/2015 | Son | F04C 11/008 417/349 |
| 2016/0273537 | A1* | 9/2016 | Hayashi | F04C 29/12 |
| 2017/0276135 | A1* | 9/2017 | Komai | H02K 15/028 |

FOREIGN PATENT DOCUMENTS

| | | |
|---|---|---|
| JP | 2015086751 | 5/2015 |
| KR | 1020150083242 | 7/2015 |

* cited by examiner (a)

(b)

COMPRESSOR APPARATUS AND MANUFACTURING METHOD OF THE SAME

CROSS-REFERENCE TO RELATED APPLICATIONS

This application is a National Stage application under 35 U.S.C. § 371 of International Application No. PCT/KR2019/008631, filed on Jul. 12, 2019, which claims the benefit of Korean Application No. 10-2018-0081773, filed on Jul. 13, 2018. The disclosures of the prior applications are incorporated by reference in their entirety.

TECHNICAL FIELD

The present disclosure relates to a compressor apparatus and a method of manufacturing a compressor apparatus. More specifically, the present disclosure relates to a scroll compressor apparatus in which a compression portion for compressing refrigerant and a drive portion for supplying power to the compression portion are assembled at one time in a casing.

BACKGROUND ART

Generally, a compressor apparatus is applied to a refrigerating cycle such as a refrigerator or an air conditioner (hereafter referred to as a refrigerating cycle). The compressor apparatus provides the work necessary for heat exchange in the refrigerating cycle by compressing the refrigerant.

Compressor apparatuses may be divided into reciprocating, rotary, scroll, etc. type compressor apparatuses depending on how refrigerants are compressed. Among them, the scroll compressor apparatus has a fixed scroll fixed in the inner space of a closed container and an orbiting scroll engaged with the fixed scroll and orbiting such that a compression chamber is defined between a fixed wrap of the fixed scroll and an orbiting wrap of the orbiting scroll.

The scroll compressor apparatus can achieve a relatively high compression ratio compared to other types of compressor apparatuses. Because of the advantage that the intake, compression and discharge cycles of the refrigerant can be smoothly connected to each other to obtain stable torque, the scroll compressor apparatus is widely used for refrigerant compression in air conditioning apparatus and the like.

The conventional scroll compressor apparatus includes a casing that forms the appearance and has a discharger for discharging the refrigerant, a compression portion fixed to the casing to compress the refrigerant, and a drive portion fixed to the casing to drive the compression portion.

The compressor includes a fixed scroll fixed to the casing and with a fixed wrap and an orbiting scroll containing an orbiting wrap that engaged with the fixed wrap and is driven by the drive portion.

In this conventional scroll compressor apparatus, the compression portion is provided between the discharger and the drive portion so that the discharger is located on the side or bottom. Thus, compressed refrigerant in the compression portion could be discharged directly into the discharger.

The orbiting scroll of the compression portion produces a strong vibration due to eccentric rotation relative to the fixed scroll and rotatable shaft. Therefore, the conventional scroll compressor apparatus needed to have a balancer installed in a direction from the drive portion to the discharger.

However, since the balancer is connected to a rotatable shaft extending from the drive portion, the rotatable shaft is bent by the vibration of the balancer, or the flow resistance is generated because the balancer rotates in contact with oil or the like.

To solve this problem, a scroll compressor apparatus has appeared in which the drive portion is located between the discharger and the compression portion and is referred to as a lower type scroll compressor apparatus.

Because the scroll compressor apparatus has the drive portion between the discharger and the compression portion, the balancer could be placed between the drive portion and the compression portion.

As a result, in the scroll compressor apparatus, the balancer is not installed outside the drive portion or the compression portion. Thus, the rotatable shaft could not be bent due to the balancer, or the balancer could not be immersed and rotated in the fluid.

In the conventional scroll compressor apparatus, the drive portion and the compression portion are coupled to the inside wall of the casing 100 and are received in the casing 100. Thus, the drive portion is first welded to the casing inner wall. Then, the compression portion is inserted into the casing, and is connect to the drive portion. Then, the compression portion is welded to the inner wall of the casing.

FIG. 1 shows an assembly method and process of a conventional scroll compressor apparatus.

Referring to FIG. 1*a*, a stator 210 forming a rotating magnetic field, and a rotor 220 configured to rotate by the rotating magnetic field are provided. While a coil is wound around the inner circumferential surface of the stator 210, the outer circumferential surface thereof may be made of a metal such as steel.

Referring to FIG. 1*b*, the drive portion 200 is inserted into the receiving shell 110 forming the outer circumferential surface of the casing, and then the drive portion 200 is welded to the casing 100 through the welding mechanism T.

Referring to FIG. 1*c*, a compression portion 300 composed of a mainframe 310 and a fixed scroll 320 is inserted into the casing 100 and is mounted on the drive portion 200.

In this connection, a rotatable shaft 230 for rotating an orbiting scroll provided inside the fixed scroll 320 may be coupled to the compression portion 300.

The rotatable shaft 230 may be coupled to the rotor 220 by press fitting or the like while coupling the compression portion 300 to the drive portion 200.

The positions of the drive portion 200 and the compression portion 300 are finally fixed and the angle and position of the rotatable shaft 230 are adjusted.

Referring to FIG. 1*d*, once the positions of the rotatable shaft 230 and the compression portion 300 are fixed, the outer circumferential surface of the compression portion 300 and the inner wall of the casing 100 are welded and coupled to each other using a welding mechanism t. As a result, the conventional scroll compressor apparatus may be assembled by firmly coupling the drive portion 200 and compression portion 300 to the casing 100.

However, in the conventional compressor apparatus assembly method, in the process of assembling the drive portion 200 and the compression portion 300, there was a problem that the compression portion 300 could be coupled to the drive portion 200 in a far away or very close manner from the driver or to the driver and thus is not designed in an intended manner.

Further, in the process of welding the drive portion 200 to the casing 100, there is a risk that the rotatable shaft 230 could be misaligned with each other. Further, the shaft may be misaligned with each other when the compression portion 300 is inserted into the drive portion 200 and is welded to the casing 100.

Further, even when the rotatable shaft 230 is misaligned with each other finely, the rotatable shaft 230 rotates at a high pressure and at a high speed. Thus, there is a problem that the rotatable shaft 230 is broken or the compression portion 300 is broken.

Furthermore, after completing the welding of the drive portion 200 to the casing, the compression portion 300 must be additionally welded. Thus, there has been a problem that the assembling process is complicated and the productivity is low.

DISCLOSURE OF INVENTION

Technical Problem

The present disclosure aims to provide a compressor apparatus manufacturing method in which a fixed portion and a compressor can be fixed to a casing at one time by assembling the fixed portion and the compressor outside the casing.

The present disclosure aims to provide a compressor apparatus manufacturing method in which the fixed portion and the compressor may be prevented from being misaligned with each other in a spaced direction or a radial direction when they are assembled to the casing.

The present disclosure aims to provide a compressor apparatus manufacturing method in which the welding process is omitted and which firmly couples the fixed portion and the compressor to the casing.

The present disclosure aims to provide a compressor apparatus manufacturing method in which the fixed portion and the compressing unit are prevented from varying in a shape or position thereof in the process of coupling the compression unit and the fixed portion to the casing.

The present disclosure aims to provide a compressor apparatus manufacturing method in which a process for coupling the fixed portion and the compressor apparatus unit to the casing may be shortened.

Solution to Problem

In one aspect, there is provided a compressor apparatus comprising: a casing defining appearance of the apparatus; and a driver coupled to an inner circumferential surface of the casing and configured to rotate a rotatable shaft; a compressor coupled to the rotatable shaft and configured to compress fluid, wherein the compressor apparatus is characterized in that the driver and the compressor are fixed to the fastening member which is detachably attached to at least one of the side face of the driver or the side face of the compressor and thus, the combination of the driver and the compressor is coupled to an inner circumferential surface of the casing.

In one implementation, the driver may include a plurality of drive collection channels configured to be recessed in the outer circumferential surface so that the fluid may pass therethrough.

In one implementation, the compressor may include a plurality of compression collection channels that are recessed in the outer circumferential surface at positions corresponding to the drive collection channels so that the fluid may pass therethrough. At least one of the drive collection channels and at least one of the compression collection channels may be detachably coupled, at the same time, to the fastening member.

In one implementation, the drive collection channel and the compression collection channel to which the fastening member is detachably coupled at the same time may have the same width.

In one implementation, the drive collection channel and the compression collection channel to which the fastening member is detachably coupled at the same time may have the same cross section as that of the fastening member.

In one implementation, at least one of the compression collection channels and at least one of the drive collection channels may be configured to have different cross-sectional shapes and be supported by the free end of the fastening member.

In one implementation, at least a portion of the at least one of the drive collection channels has a cross-sectional area smaller than a cross-sectional area of the at least one of the compression collection channels.

In one implementation, the compressor and the driver are simultaneously inserted into the casing, wherein when the casing is shrunk, the compressor and the driver is coupled with the casing at the same time.

In one implementation, the compressor and the driver may be fitted to the casing while the compressor and the driver are coupled to the fastening member.

In one implementation, the fastening member includes a fastening jig that is detachably coupled to the compression collection channel and the drive collection channel at the same time, and a support jig detachably coupled to one of the compression collection channel and the drive collection channel and to support the other of the compression collection channel and the drive collection channel.

In one implementation, the compressor and the driver are configured to be coupled to the fastening member when the compressor and the driver are inserted into the casing.

In one implementation, the first fastening member includes: a mounting body mounted on one end of the casing; an inserted portion extending from the mounting body and inserted into the casing; and a seat extending from the inserted portion inwardly to define a mounting position of at least one of the driver or the compressor.

In one implementation, the first fastening member further includes: an extension extending from the mounting body to a refrigerant inflow pipe coupled to the casing; and a fixed pin extending from the extension to be inserted into the refrigerant inflow pipe and detachably coupled to the compressor.

In another aspect, there is provided a method for manufacturing a compressor apparatus, wherein the apparatus includes: a casing having a space in which fluid is stored or flow; a driver coupled to an inner circumferential surface of the casing and configured to rotate a rotatable shaft; and a compressor coupled to the rotatable shaft and disposed within the casing, wherein the compressor is configured to compress the fluid, wherein the method comprises: an assembly step for assembling the compressor and the driver with each other outside the casing; an inserting step for inserting the combination of the compressor and the driver into the casing; and a coupling step for coupling the compressor and the driver to the casing.

In one implementation, the method further comprises a fixing step for coupling a side face of the compressor and a side face of the driver to a fastening member such that the compressor or the driver is prevented from rotating and moving in a radial direction of the rotatable shaft, or such that the compressor or the driver is prevented from moving in a longitudinal direction of the rotatable shaft.

In one implementation, the fixing step includes: a side-face fixing step for fixing an outer circumferential surface of the compressor and an outer circumferential surface of the driver to the fastening member; and a spacing fixing step for fixing an outer circumferential surface of one of the compressor and the driver and one end face of the other thereof to the fastening member.

In one implementation, the fixing step includes an adapting step for fixing a refrigerant inflow pipe in communication with the casing and fixing an inflow hole of the compressor.

In one implementation, the method further comprises a removal step of separating the fastening member from the casing.

Advantageous Effects of Invention

The present disclosure achieves the effect that the angle or position of the compressor and the fixed portion may be fixed in the course of combining the compressor and the fixed portion to the casing.

The present disclosure achieves the effect that the compressor and the fixed portion is coupled to the casing at one time, thus achieving an improvement in productivity.

The present disclosure achieves the effect of lowering the defects because the installation process is simplified because the compressor and the fixed portion are simultaneously joined to the casing.

The present disclosure achieves the effect that the welding process may be omitted when the compressor and the fixed portion are joined to the casing.

MODE FOR THE INVENTION

Figure 1:
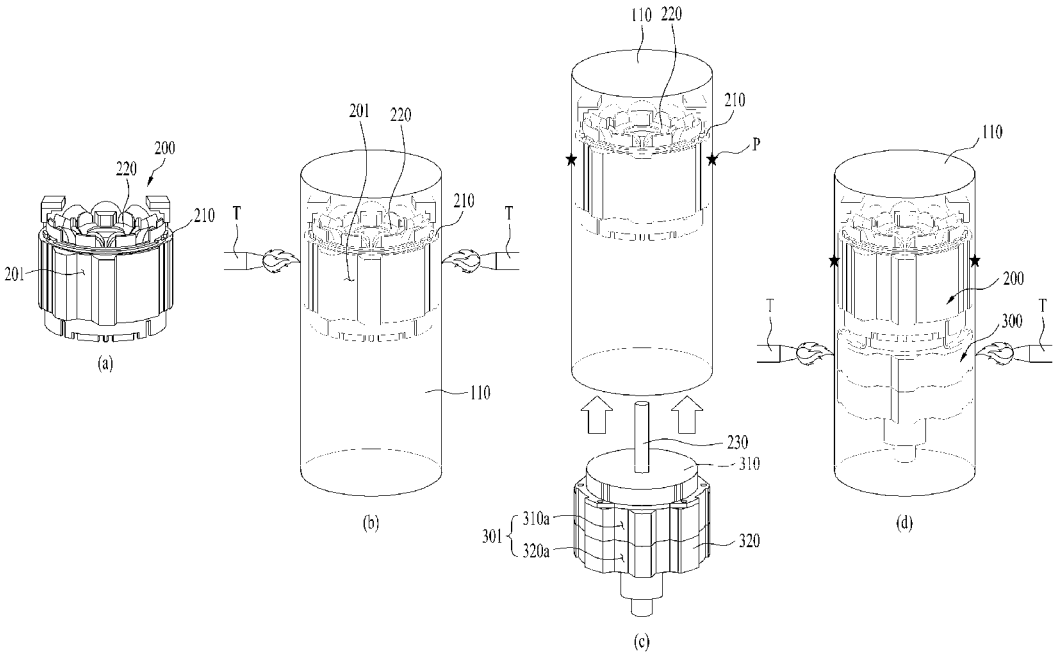
FIG. 1 shows a conventional method of manufacturing a compressor apparatus.

Hereinafter, the embodiments disclosed herein will be described in detail with reference to the accompanying drawings. In the present specification, the same or similar reference numerals are given to the same or similar components across different embodiments. The same or similar components are described first in a first embodiment, and then, descriptions thereof in subsequent embodiments are applied to the first descriptions thereof. The singular forms as used herein include the plural forms unless the context clearly dictates otherwise. Further, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. Further, it should be noted that the accompanying drawings are only for the purpose of facilitating understanding of the embodiments disclosed herein, and should not be construed as limiting the technical idea disclosed in the present specification by the attached drawings.

Figure 2:
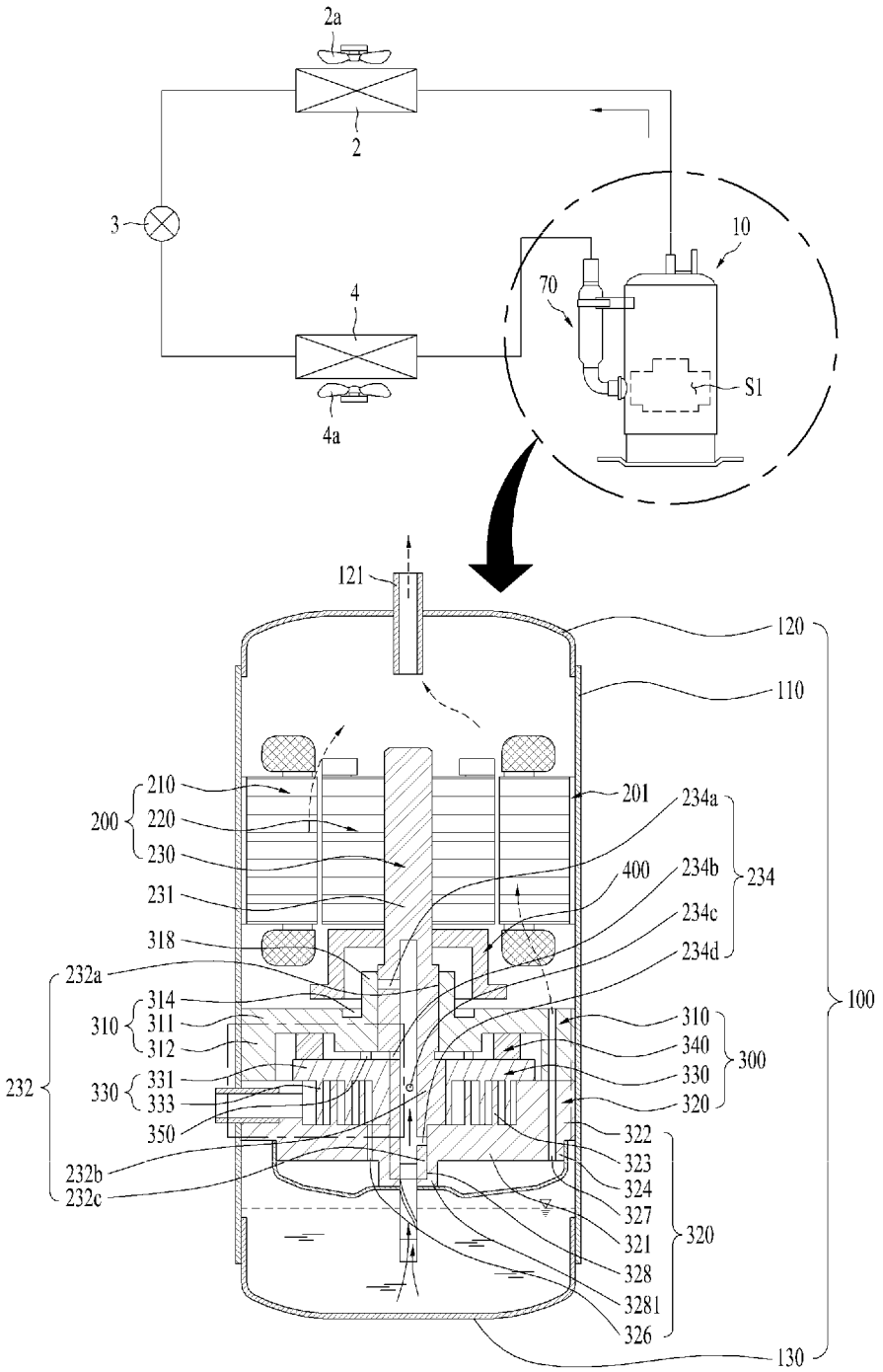
FIG. 2 shows a refrigerant cycle to which a compressor apparatus in accordance with the present disclosure may be applied and a structure of the compressor apparatus.

FIG. 2 shows a refrigerating cycle 1 with a scroll compressor apparatus according to one embodiment of the present disclosure.

Referring to FIG. 2, a refrigerating cycle 1 with a scroll compressor apparatus according to one embodiment of the present disclosure includes a scroll compressor apparatus 10, a condenser 2 and a condensing fan 2*a*, an expander 3, an evaporator 4, and an evaporation fan 4*a*, all of which defines a closed loop.

A scroll compressor apparatus 10 according to an embodiment of the present disclosure may include a casing 100 having a space for fluid storage or flow, a drive portion 200 coupled to the inner circumferential surface of the casing 100 to rotate the rotatable shaft 230, a compression portion 300 coupled to the rotatable shaft 230 within the casing to compress the fluid.

The casing 100 may have a discharger 121 for discharging the refrigerant at one end thereof. Specifically, the casing 100 may include a receiving shell 110 that is provided in a cylindrical shape and accommodates the drive portion 200 and the compression portion 300, a discharging shell 120 coupled to one end of the receiving shell 110 and having the discharger 121, and a shielding shell 130 coupled to the other end of the receiving shell 110 to seal the receiving shell 110.

The drive portion 200 includes a stator 210 forming a rotating magnetic field, and a rotor 220 adapted to rotate by the rotating magnetic field. The rotatable shaft 230 may be coupled to the rotor 220 to rotate therewith.

The stator 210 has a plurality of slots defined in the inner circumferential surface thereof in the circumferential direction. The coil is wound around and in the slots. The rotor 220 may be embodied as a permanent magnet and may be received in and coupled to the stator 210 to generate rotational power. The rotatable shaft 230 may be press-fitted into the center of the rotor 220.

The compression portion 300 may include a fixed scroll 320 coupled to the receiving shell 110, an orbiting scroll 330 coupled with the rotatable shaft and engaged with the fixed scroll 320 to form a compression chamber, and a mainframe 310 which rests on the fixed scroll 330 and accommodates the orbiting scroll 330 and forms the appearance of the compressor 10.

In one embodiment of the present disclosure. The compressor apparatus 10 may include the drive portion 200 between the discharger 121 and the compression portion 300.

In other words, the drive portion 200 is provided adjacent to the discharger 121. The compression portion 300 may be located adjacent to the drive portion 200 and away from the discharger 121. For example, when the discharger 121 is provided on a top of the casing 100, the compression portion 300 is provided under the drive portion 200. The drive portion 200 may be provided between the discharger 121 and the compression portion 300.

Thus, the rotatable shaft 230 may be configured to be supported on the fixed scroll 320 as well as the mainframe 310 and the orbiting scroll 330. Further, the shaft 230 may extend through the fixed scroll 320 and protrude to the outside of the compression portion 300.

Thus, when a fluid such as oil is stored outside the compression portion 300, the stored oil and the rotatable shaft 230 may be in direct contact to more easily supply the oil inside the compression portion 300.

Further, the rotatable shaft 230 is configured so as to be in surface contact with the orbiting scroll 330 as well as the fixed scroll 320. Thus, the rotatable shaft 230 may support both the gas force (inflow force) generated when fluid enters the compression portion 300 and the reaction force generated when the refrigerant compresses within the compression portion 300. Thus, it is possible to prevent the axial vibration of the vibration occurring at the orbiting scroll 330. The rollover moment of the orbiting scroll 330 may be drastically reduced, such that noise and vibration may be suppressed as much as possible. Further, the rotatable shaft 230 supports the back pressure generated when the refrigerant is discharged outside the casing 100 to reduce the normal force by which the orbiting scroll 330 and the fixed scroll 320 are pushed in the axial direction, and greatly reduce the friction of the orbiting scroll 330 and the fixed scroll 320. As a result, in the compressor apparatus 10 in accordance with the present disclosure, the axial vibration and rollover moment of the orbiting scroll 330 within the compression portion 300 may be greatly reduced, and the frictional force of the orbiting scroll can be reduced to greatly enhance the durability of the compression portion 300.

Further, the balancer 400 may be installed between the drive portion 200 and the compressor apparatus 10 to damp vibration sufficiently. As a result, it may be possible to omit extending the rotatable shaft to the outside of the compression portion 300 or to the outside of the driver 200 to further install the balancer 400, or to omit installing the plurality of balancers on the outside of the driver.

Accordingly, the casing 100 may be reduced in volume, and the balancer may be omitted at the distal end of the rotatable shaft 400 to prevent deformation of the rotatable shaft 400. Furthermore, when the casing 100 is provided in a vertical direction or the like, the balancer may be prevented from being immersed in refrigerant or oil provided under the casing 100, thereby minimizing energy loss.

Specifically, the rotatable shaft 230 coupled to the drive portion 200 may extend through the mainframe 310 and the orbiting scroll 330 in a direction away from the outlet 121 and may be rotatably coupled to the fixed scroll 320.

In this connection, the rotatable shaft 230 may extend through the fixed scroll 320.

The mainframe 310 includes a main head plate 311 extending from the drive portion 200 in a direction away from the discharger 121 or disposed below the drive portion 200, a main side plate 312 extending from the inner peripheral surface of the main head plate 311 in a direction away from the drive portion 200 and seated on the fixed scroll 330, a main hole 318 passing through the main head plate 311 to receive the rotatable shaft, and a main bearing 3181 extending from the main hole 318 and rotatably receiving the rotatable shaft 230.

The main head plate 311 or the main side plate 312 may further include a main hole for guiding refrigerant discharged from the fixed scroll 320 to the discharger 121.

The main head plate 311 may further include an oil pocket 314 defined concavely outside the main bearing 318. The oil pocket 314 may be configured in an annular shape and may be eccentric relative to the main bearing 318.

The oil pocket 314 may be configured so that the oil supplied through the rotatable shaft 230 is collected thereto from which the oil, in turn, is supplied to the engaged portion between the fixed scroll 320 and the orbiting scroll 330.

The fixed scroll 320 may include a fixed head plate 321 that extends from the main head plate 311 in a direction away from the driver 200 and is coupled to the receiving shell 110 to form the other face of the compression portion 300, a fixed side plate 322 extending from the fixed head plate 321 toward the discharger 121 and configured to contact the main side plate 312, and a fixed wrap 323 disposed on the inner circumferential surface of the fixed side plate 322 to form a compression chamber in which refrigerant is compressed.

In one example, the fixed scroll 320 may include a fixed through-hole 328 through the rotatable shaft 230 passes, and a fixed bearing 3281 extending from the fixed through-hole 328 and rotatably supporting the rotatable shaft. The fixed bearing 3281 may be formed at the center of the fixed head plate 321.

The thickness of the fixed head plate 321 may be equal to the thickness of the fixed bearing 3281. In this regard, the fixed bearing 3281 may be inserted into the fixed through-hole 328 rather than extending from the fixed head plate 321 in a protruding manner therefrom.

The fixed side plate 322 has an inflow hole 325 through which refrigerant is introduced into the fixed wrap 323. The fixed head plate 321 may have a discharge hole 326 for discharging the refrigerant. The discharge hole 326 may be provided in the center of the fixed wrap 323. Alternatively, the hole 326 may be spaced apart from the fixed bearing 3281 to avoid interference with the fixed bearing 3281. The hole 326 may be provided in a plural manner.

The orbiting scroll 330 may include an orbiting head plate 331 disposed between the mainframe 310 and the fixed scroll 320 and an orbiting wrap 333 forming a compression chamber with the fixed wrap 323 in the orbiting head plate.

The orbiting scroll 330 may further include an orbiting through-hole 338 formed through the orbiting head plate 331 so that the rotatable shaft 230 is rotatably engaged therein.

The rotatable shaft 230 may be eccentric relative to the orbiting through-hole 338 at a portion of the rotatable shaft 230 coupled to the orbiting through-hole 338. As such, the orbiting scroll 330 may be engaged with and move along the fixed wrap 323 of the fixed scroll 320 when the rotatable shaft 230 rotates, thereby to compress the refrigerant. The compressed refrigerant may flow along the space formed by the fixed wrap 323 and the orbiting wrap 333 and may be discharged to the discharge hole 326.

In one example, the main scroll 330 and the fixed scroll 320 are fixedly coupled to the receiving shell 110, but the orbiting scroll 330 is configured for regularly orbiting relative to the fixed scroll 320.

To this end, the compression portion 300 may further comprise an Oldham's ring 340. The Oldham's ring 340 may be configured to contact the orbiting scroll 330 and the mainframe 310 and be disposed between the orbiting scroll 330 and the main frame 310. The Oldham's ring 340 may be configured to allow orbiting of the orbiting scroll 330 along the fixed wrap 323 of the fixed scroll 320 while preventing the orbiting scroll 330 from spinning. The orbiting scroll 330 is configured to form the compression chamber with the fixed scroll 330.

In one example, the discharge hole 326 may be advantageous to be oriented towards the discharger 121. Thus, the refrigerant discharged from the discharge hole 326 may be discharged to the discharger 121 without a large change in the flow direction.

However, the compression portion 300 extends from the drive portion 200 in a direction away from the discharger 121. Due to the structure in which the fixed scroll 320 is disposed at the outermost of the compression portion 300, the discharge hole 326 must be provided to eject the refrigerant in the direction away from the discharger 121.

In other words, the discharge hole 326 is provided to eject the refrigerant from the fixed head plate 321 in a direction away from the discharger 121.

In this connection, when the refrigerant is directly injected into the discharge hole 326, the refrigerant may not be discharged smoothly to the discharger 121. If the oil or the like is present on one side or the bottom of the compression portion 300, the refrigerant may collide with the oil and be cooled.

To prevent this situation, the compressor apparatus 10 may further include a muffler 500 which is coupled to the outermost of the fixed scroll 320 and provides a space for guiding the refrigerant to the discharger 121.

The muffler 500 may be provided to seal one face of the fixed scroll 320 away from the discharger 121 so as to guide refrigerant discharged from the fixed scroll 320 to the discharger 121.

Thus, the refrigerant ejected from the discharge hole 326 may be discharged to the discharger 121 via switching the flow direction along the inner surface of the muffler 500.

In one example, the fixed scroll 320 is coupled to the receiving shell 110. Thus, the refrigerant may be disturbed by the fixed scroll 320 and may be prevented from moving to the discharger 121. For this reason, the fixed scroll 320 may further include a bypass hole 327 passing through the fixed head plate 321 through which the refrigerant may pass through the fixed scroll 320.

The bypass hole 327 may be provided to communicate with the main hole 327. Thus, the refrigerant may flow through the compression portion 300 and by the drive portion 200 and be discharged to the discharge hole 121.

In one example, the refrigerant is compressed to a higher pressure as it goes from the outer periphery of the fixed wrap 323 toward the interior thereof. Thus, the interior of the fixed wrap 323 and the orbiting wrap 333 may be classified as a high pressure region, while the outer periphery of each of the fixed wrap 323 and the orbiting wrap 333 may be classified as a middle pressure region.

Further, the space enclosed by the rotatable shaft 230, the main frame 310, and the orbiting scroll 330 may also define both a high pressure region and a middle pressure region.

A back pressure seal 350 may be provided between the main frame 310 and the orbiting scroll 330 to divide the space surrounded by the rotatable shaft 230, the main frame 310 and the orbiting scroll 330 into a high pressure region and a middle pressure region. The back pressure seal 350 may serve as a sealing member.

In one example, the casing 100 may store oil in one end thereof to lubricate the compression portion 300. The oil may be supplied to the compression portion 300 via the rotatable shaft 260 due to pressure differentials between the high and middle pressures.

Hereinafter, the structure in which oil is supplied to the rotatable shaft 230 and the compression portion 300 will be described in detail.

The rotatable shaft 230 is coupled to the drive portion 200 and has an oil supply channel 234 for guiding the oil present at one end or the lower portion of the casing 100 upwards.

Specifically, the rotatable shaft 230 may be press-fitted into the center of the rotor 220 at one end or upper end of the shaft 230. The other end or bottom end of the shaft 230 may be coupled to the compression portion 300 and supported in the radial direction.

Thus, the rotatable shaft 230 may transmit the rotational force of the drive portion 200 to the orbiting scroll 330 of the compression portion 300.

The rotatable shaft 230 may include a main shaft 231 rotated by the drive portion 200 and a bearing 232 coupled to an outer circumferential surface of the main shaft 231 to support the main shaft 231 to rotate smoothly.

The bearing 232 may be provided as a separate member from the main shaft 231 or may be integrally formed with the main shaft 231.

The bearing 232 may include a main bearing 232*c* inserted into the main bearing 318 of the main frame 310 and supported therein in the radial direction, a fixed bearing 232*a* inserted in the fixed bearing 3281 of the fixed scroll 320 so as to be supported therein in the radial direction, and an eccentric portion 232*b* disposed between the main bearing 232*c* and the fixed bearing 232*a* and inserted into the orbiting through-hole 338 of the orbiting scroll 330.

The main bearing 232*c* and the fixed bearing 232*a* are coaxial with each other. The eccentric portion 232*b* may be radially eccentric relative to the main bearing 232*c* or the fixed bearing 232*a*.

The eccentric portion 232*b* may be defined such that its outer diameter is smaller than the outer diameter of the main bearing 232*c* and larger than the outer diameter of the fixed bearing 232*g*. In this case, it may be advantageous to insert the rotatable shaft 230 through the respective bearings 318, 328, and 338.

Further, the eccentric portion 232*b* may not be formed integrally with the rotatable shaft 230 but may be formed as a separate bearing. In this case, when the outer diameter of the fixed bearing 232*c* is not smaller than the outer diameter of the eccentric portion 232*b*, the rotatable shaft 230 may pass through the respective bearings 318, 328 and 338.

The rotatable shaft 230 has an oil supply channel 234 for supplying the oil onto the outer peripheral surface of the main bearing 232*c*, the outer peripheral surface of the fixed bearing 232*a*, and the outer circumferential surface of the eccentric portion 232*b*.

Further, a plurality of oil holes 234*a, b, c,* and d may be formed to pass through the outer circumferential surface of the main bearing 232*c*, the outer peripheral surface of the fixed bearing 232*a*, the outer circumferential surface of the eccentric portion 232*b* of the rotatable shaft 230.

Specifically, the oil hole may include a first oil hole 234*a*, a second oil hole 234*b*, a third oil hole 234*d*, and a fourth oil hole 234*e*.

First, the first oil hole 234*a* may be defined to pass through the outer circumferential surface of the main bearing 232*c*.

Specifically, the first oil hole 234*a* may be defined to extend from the oil supply channel 234 through the outer circumferential surface of the main bearing 232*c*.

Also, the first oil hole 234*a* may be defined to pass through, for example, an upper portion of the outer circumferential surface of the main bearing 232*c*. However, the present disclosure is not limited thereto.

That is, the first oil hole 234*a* may be defined to penetrate the lower portion of the outer circumferential surface of the main bearing 232*c*.

In one example, the first oil hole 234*a* may include a plurality of holes, unlike shown in the drawing.

Further, when the first oil hole 234*a* includes a plurality of holes, the holes may be defined only in the upper or lower portion of the outer circumferential surface of the main bearing 232*c*, or may be respectively defined in both of the upper and lower portions of the outer circumferential surface of the main bearing 232*c*.

In one example, the rotatable shaft 230 may include an oil feeder 233 configured to pass through the muffler 500 and contact the stored oil in the casing 100. The oil feeder 233 may include an extended shaft 233*a* passing through the muffler 500 to contact the oil and a spiral groove 233*b* spirally defined in the outer circumferential surface of the extended shaft 233*a* and in communication with the supply channel 234.

Thus, when the rotatable shaft 230 rotates, the oil rises up through the oil feeder 233 and the supply channel 234, due to the spiral groove 233*b* and the viscosity of the oil and the pressure difference between the high pressure region and the middle pressure region within the compression portion 300 and thus is discharged to the plural oil holes.

The oil discharged through the plurality of oil holes 234*a*, 234*b*, 234*d*, and 234*e* forms an oil film between the fixed scroll 320 and the orbiting scroll 330 to maintain the airtight state, and to absorb the frictional heat generated from the frictional portion between the components of the compression portion 300 to dissipate heat.

Specifically, high pressure oil guided along the rotatable shaft 230, that is, the oil supplied through the first oil hole 234*a* may be provided to lubricate the main frame 310 and rotatable shaft 230.

Further, the oil may be discharged through the second oil hole 234*b* and supplied to the top face of the orbiting scroll 330. The oil supplied to the top face of the orbiting scroll 330 may be guided through the pocket groove 314 to the middle pressure chamber.

In one example, oil discharged through the first oil hole 234*a* or the third oil hole 234*d* as well as the second oil hole 234*b* may be supplied to the pocket groove 314.

In one example, oil fed to the middle pressure chamber may be supplied to Oldham's ring 340, which is installed between the orbiting scroll 330 and the main frame 310, and to the fixed side plate 322 of the fixed scroll 320. This may also reduce wear on the fixed side plate 322 of the fixed scroll 320 and Oldham's ring 340.

Further, the oil supplied to the third oil hole 234*c* is supplied to the compression chamber to not only reduce abrasion due to friction between the orbiting scroll 330 and the fixed scroll 320, but also form an oil film such that heat may be dissipated to improve the compression efficiency.

The compressor apparatus 10 has been described based on the centrifugal oil feeding structure in which oil is supplied to the bearing using the rotation of the rotatable shaft 230. However, the present disclosure is not limited thereto. The compressor apparatus 10 may be applied to a pressure difference based oil feeding structure that supplies oil using the pressure difference inside the compression portion 300 and to a forced oil feeding structure that supplies oil through trochoid pump.

The oil supplied to the compression portion 300 or the oil stored in the casing 100 may move to the upper portion of the casing 100 together with the refrigerant as the refrigerant is discharged to the discharger 121.

In this connection, the oil has a higher density than the refrigerant and cannot move to the discharger 121, and is attached to the inner wall of the discharging shell 110 and the receiving shell 120.

In this connection, the drive portion 200 and the compression portion 300 may have a collection channel defined in the outer circumferential surface thereof such that the oil attached to the inner wall of the casing 100 can be collected into the oil storage space of the casing 100 or the shielding shell 130.

Figure 3:
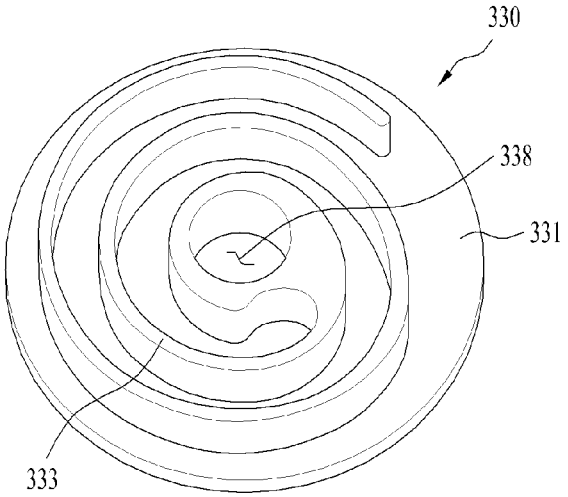
FIG. 3 shows a scroll structure of the compressor apparatus in accordance with the present disclosure.
Figure 3:
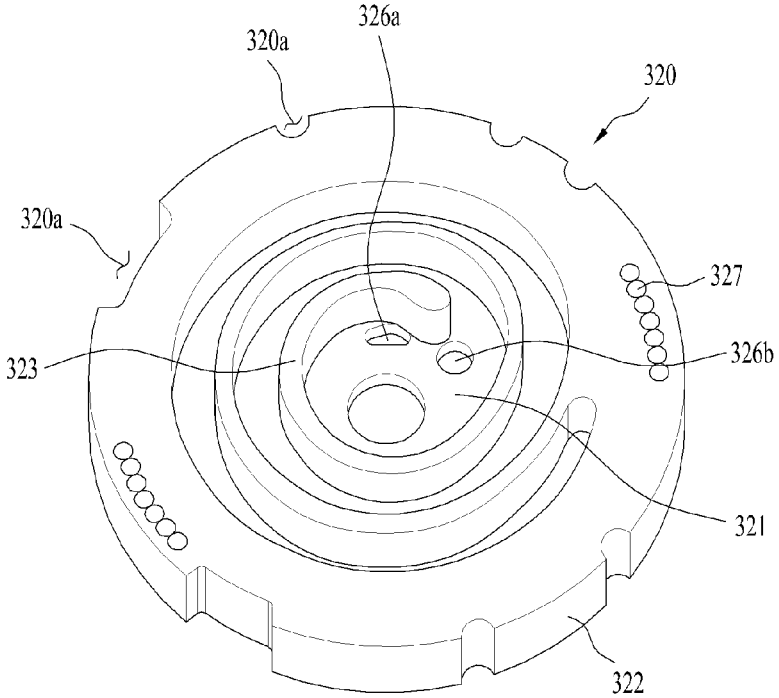

FIG. 3 shows the structure of the orbiting scroll 330 and the fixed scroll 320 of the compressor apparatus 10 in accordance with the present disclosure. FIG. 3*a* shows the orbiting scroll. FIG. 3*b* shows the fixed scroll.

The orbiting scroll 330 may have the orbiting wrap 333 on one face of the orbiting head plate 331. The fixed scroll 320 may have the fixed wrap 323 on one face of the fixed head plate 321.

Further, the orbiting scroll 330 is formed of a rigid body sealed to prevent refrigerant from being discharged to the outside, while the fixed scroll 320 includes an inflow hole 325 communicating with a refrigerant supply line for introducing low-temperature and low-pressure refrigerant such as liquid, a discharge hole 326 for discharging the high temperature high pressure refrigerant, and a bypass hole 327 defined in the outer circumferential surface thereof for discharging the refrigerant discharged from the discharge hole 326.

In one example, the fixed wrap 323 and the orbiting wrap 333 are constructed in a shape similar to an involute shape such that they may be engaged with each other in at least two points to form a compression chamber in which the refrigerant is compressed.

Specifically, each of the fixed wrap 323 and the orbiting wrap 333 in accordance with the present disclosure is formed by combining 20 or more arcs, and may be provided such that the radius of curvature varies between portions thereof.

In other words, the compressor apparatus in accordance with the present disclosure is configured such that the rotatable shaft 230 penetrates the fixed scroll 320 and the orbiting scroll 330 and thus the radius of curvature and compression space of the fixed wrap 323 and the orbiting wrap 333 are reduced.

Therefore, to compensate for this reduction, in the compressor apparatus in accordance with the present disclosure, in order to reduce the space from which the refrigerant is discharged and to improve the compression rate, the radius of curvature of the fixed wrap 323 and the orbiting wrap 333 at a portion just prior to the discharging portion may be smaller than the perforated bearing of the rotatable shaft so as to improve the compression rate.

That is, the fixed wrap 323 and the orbiting wrap 333 may be greatly bent nearby the discharge hole 326, and may be bent more greatly as it goes toward the inflow hole 325. Thus, the radius of curvature thereof may vary from point to point.

Figure 4:
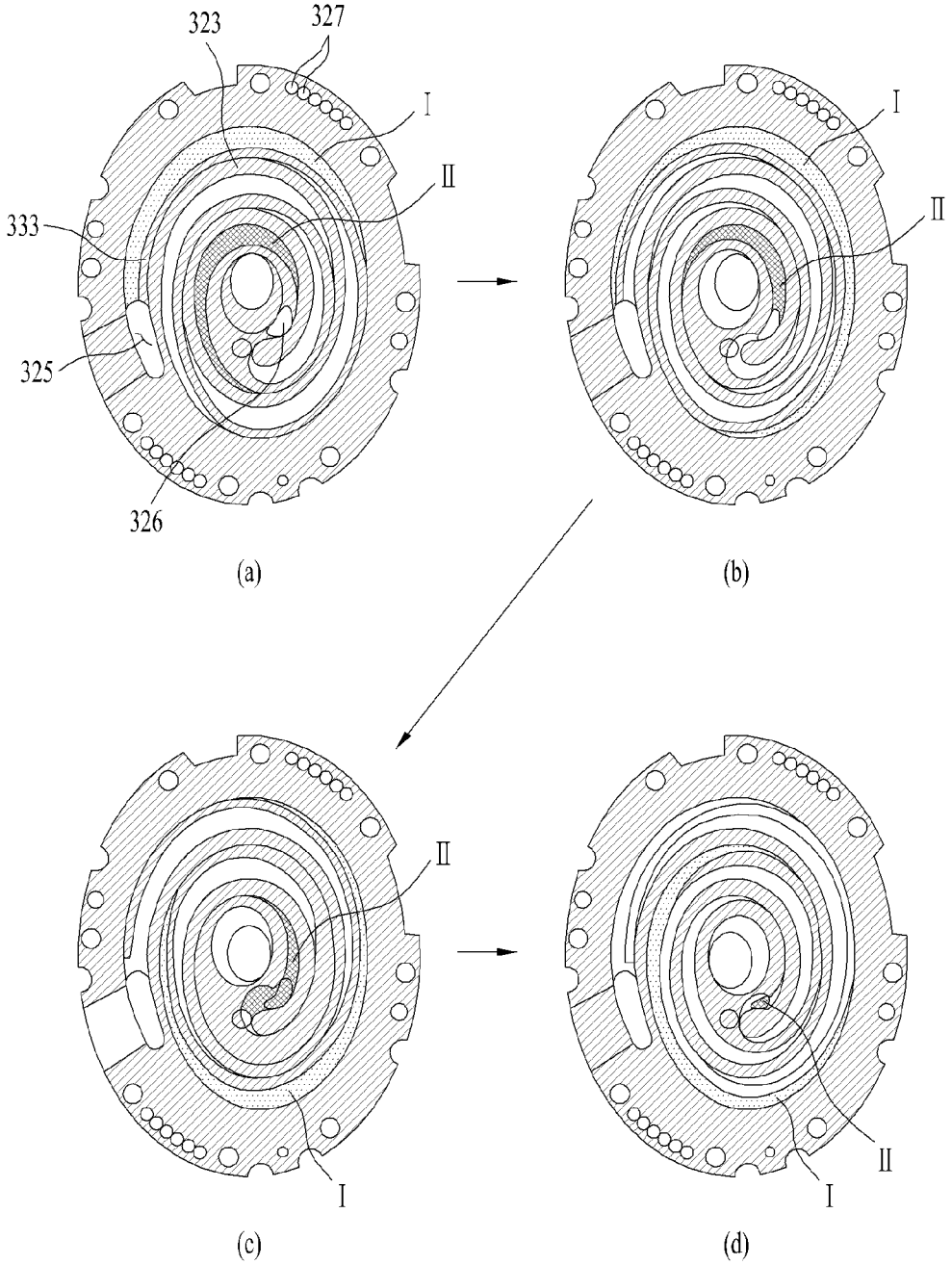
FIG. 4 shows an operating principle of the compressor apparatus in accordance with the present disclosure.

FIG. 4 shows how the fixed scroll 320 and the orbiting scroll 330 are engaged with each other and move together to compress the refrigerant.

Referring to FIG. 4*a*, the refrigerant I flows into the inflow hole 325 of the fixed scroll 320. The refrigerant II introduced before the refrigerant I is located near the discharge hole 326 of the fixed scroll 320.

In this connection, the refrigerant I exists in a space that is defined by engagement between the outer faces of the fixed wrap 323 and the orbiting wrap 333. The refrigerant II is enclosed in another regions where the fixed wrap 323 and the orbiting wrap 333 are engaged with each other at two points.

Referring to FIG. 4*b*, then, the orbiting scroll 330 starts orbiting movement. As the position of the orbiting wrap 333 changes, the points at which the fixed wrap 323 and the orbiting wrap 333 are engaged with each other travel along the extension direction of the fixed wrap 323 and the orbiting wrap 333, thereby to start to reduce the volume of the refrigerant. Thus, the refrigerant I begins to move and be compressed. The refrigerant II is further compressed and begins to be guided to the discharge hole 327.

Referring to FIG. 4*c*, the refrigerant II is discharged from the discharge hole 327. The refrigerant I moves as the two points at which the fixed wrap 323 and the orbiting wrap 333 are engaged with each other move in a clockwise direction. Thus, the volume thereof decreases and the refrigerant I begins to be further compressed.

Referring to FIG. 4*d*, as the two points at which the fixed wrap 323 and the orbiting wrap 333 are engaged with each other further move in a clockwise direction and approach closer to the inside of the fixed scroll such that the volume of the refrigerant is further reduced and compressed, such that the refrigerant II is almost completely discharged.

Thus, as the orbiting scroll 330 moves in an orbiting manner, the refrigerant may be linearly or continuously compressed as it moves in the fixed scroll.

The FIG. shows the inflow of refrigerant into the inflow hole 325 discontinuously, but this is for illustrative purposes only, and the refrigerant may be fed continuously. In a space defined between the two points at which the fixed wrap 323 and the orbiting wrap 333 are engaged with each other, the refrigerant may be accommodated therein and compressed therein.

Figure 5:
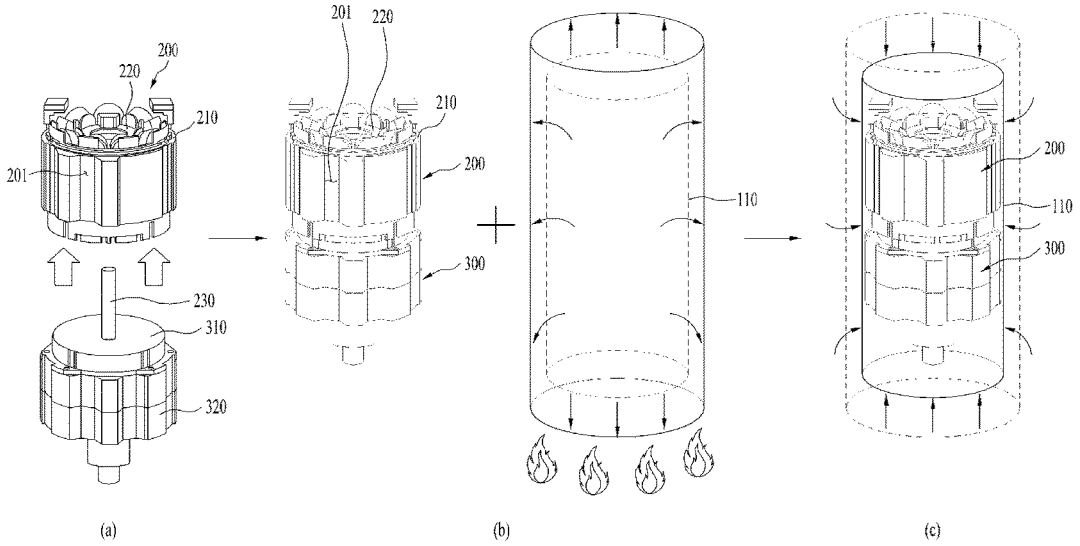
FIG. 5 shows a method of manufacturing the compressor apparatus in accordance with the present disclosure.

FIG. 5 shows a method and a process for manufacturing the compressor apparatus 10 according to the present disclosure.

Referring to FIG. 5*a*, the drive portion 200 and the compression portion 300 may first be assembled and coupled with each other outside the casing 100. The compression portion 300 may be mounted onto the drive portion 200 at one end or bottom of the drive portion 200.

In this connection, the rotatable shaft 230 may be inserted and coupled to the compression portion 300 while the shaft is mounted on the rotor 220. However, since the rotatable shaft 230 is coupled to the plurality of the bearings 232, the rotatable shaft 230 may be preferably coupled to the drive portion 200 after the shaft has been coupled to the mainframe 310, the orbiting scroll 330, and the fixed scroll 320 in advance.

When the rotatable shaft 230 has been coupled to the compression portion 300, the rotatable shaft 230 may be press-fitted into the rotor 220 and coupled thereto. In this connection, the drive portion 200 and the compression portion 300 are spaced apart from each other by the designed distance, and then the rotatable shaft 230 may be inserted and fixed in the rotor 220.

In one example, since the compression portion 300 is pre-coupled to the drive portion 200, there is no need to weld the drive portion 200 to the casing 100 to join the compression portion 300 to the drive portion 200. Further, the welding of the compression portion 300 to the casing 100 may be omitted.

In other words, the drive portion 200 and the compression portion 300 may be inserted into and fixed to the casing 100 at the same time. Thus, the process for welding the drive portion 200 and the compression portion 300 to the casing 100 may be omitted.

Moreover, when the welding process is omitted, it is possible to prevent the occurrence of defects due to the time delay and the nonuniformity of the process as occurring in the welding process.

Referring to FIG. 5*b*, to bypass the welding process, while the drive portion 200 and the compression portion 300 may be coupled to each other via a fastening member, the casing 100 may be heated.

The casing 100 may be heated by heating the casing 100 before assembling the casing 100 with the drive portion 200 and the compression portion 300.

Thus, the diameter of the casing 100 may be expanded to facilitate insertion of the combination of the drive portion 200 and the compression portion 300 into the receiving shell 110.

In one example, the receiving shell 110 is not heated. The drive portion 200 and the compression portion 300 may be press-fitted into the shell 110. However, it is desirable that the receiving shell 110 be heated because the drive portion 200 and the compression portion 300 are rubbed against the receiving shell 110 to change the position of the drive portion 200 and the compression portion 300.

Accordingly, the compressor apparatus according to the present disclosure may be configured such that when the diameter of the inner circumferential surface of the casing 100 is equal to or smaller than the diameter of each of the outer circumferential surface of the drive portion 200 and the compression portion 300, the drive portion 200 and the compression portion 300 can be fully assembled to the casing 100.

Referring to FIG. 5*c*, the casing 100 may be cooled after inserting the assembled compression portion 300 and drive portion 200 into the extended casing 100.

Accordingly, the casing 100 is thermal shrunk and is firmly coupled to the outer circumferential surface of the drive portion 200 and the outer circumferential surface of the compression portion 300, such that the drive portion 200 and the compression portion 300 may be inserted into the inner periphery of the casing 100 and be fixed thereto.

Therefore, the casing 100, the drive portion 200, and the compression portion 300 may be rigidly coupled to each other while omitting the welding process.

As a result, there is no need to weld the drive portion 200 and the compression portion 300, respectively to the casing 100. The problem that the dimension of each of the drive portion 200 and the compression portion 300 may change during the welding process may be avoided. Further, the problem that the drive portion 200 and the compression portion 300 may be bent axially or radially of the rotatable shaft may be suppressed.

In one example, even though the compression portion 300 and the drive portion 200 are preassembled with each other, the dimension of the receiving shell 110 may be widened as the compression portion 300 and the drive portion 200 are inserted thereto. Further, one of the compression portion 300 and the drive portion 200 may rotate during the insertion process or the compression portion 300 and the drive portion 200 may be misaligned with each other in the radial direction during the insertion process.

In other words, a separate configuration may be required such that the drive portion 200 and the compression portion 300 may be inserted into the receiving shell 110 such that the designed position of each of the drive portion 200 and the compression portion 300 is fixed.

Accordingly, the drive portion 200 and the compression portion 300 are provided to be coupled to the inner circumferential surface of the casing in a state when the drive portion 200 and the compression portion 300 are coupled to each other via a fastening member detachably attached to at least one of the side face of the driver and the side face of the compressor.

As such, the drive portion 200 and the compression portion 300 are coupled to each other at the dimension as designed outside the casing 100. Then, the positions thereof may be fixed even when they are put into the casing 100.

Further, since the drive portion 200 and the compression portion 300 may be coupled to the casing 100 at the same time after the drive portion 200 and the compression portion 300 have been coupled to each other, the problem that the spacing and position of the drive portion 200 and the compression portion 300 may vary as the drive portion 200 and the compression portion 300 are coupled to the casing 100 may be suppressed.

Thereby, the manufacturing reliability of the compressor apparatus 10 may be greatly improved.

The oil collection channel provided in the drive portion 200 and the compression portion 300 may be utilized to detachably connect the fastening member to the side face of the drive portion 200 and the side face of the compression portion 300.

Figure 6:
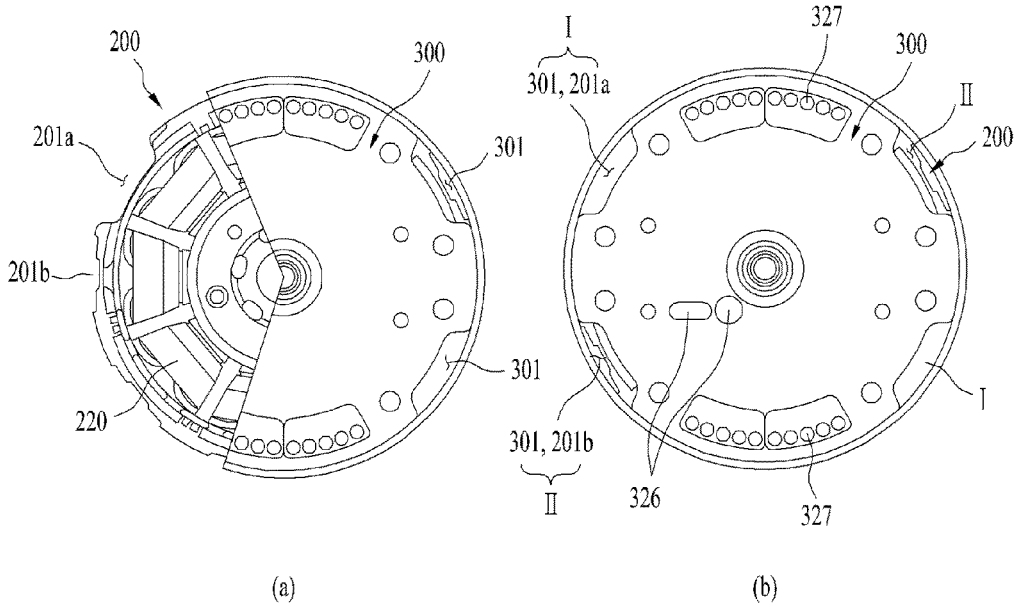
FIG. 6 shows a flow channel structure for implementation of a manufacturing method of the compressor apparatus in accordance with the present disclosure.

FIG. 6 shows the structure of the collection channel defined in the outer circumferential surface of each of the drive portion 200 and the compression portion 300.

FIG. 6*a* is a partial cut-away view of the compression portion 300 in a state when the drive portion 200 and the compression portion 300 are assembled with each other. FIG. 6*b* shows the view of the compression portion 300 from below while the drive portion 200 and the compression portion 300 are assembled to each other.

The collection channel is configured such that the oil raised to the discharger 121 together with the refrigerant is collected to the oil storage space. This channel may be achieved by d shape cut the outer circumferential surface of the drive portion 200 and the compression portion 300.

Specifically, the collection channel includes at least one drive collection channel 201 along at least one outer circumferential surface of the drive portion 200 and at least one compression collection channel 301 along the outer circumferential surface of the compression portion 300.

The drive collection channel 201 may be provided in a plural manner and may extend in the thickness direction of the stator 210 or in a direction parallel to an length of the rotatable shaft 230.

The plurality of compression collection channels 301 may be provided. The drive collection channel 201 may extend in parallel with the length of the rotatable shaft 230 and extend on the outer circumferential surface of the mainframe 310 and the outer circumferential surface of the fixed scroll 320.

The compression collection channel 301 may include a main compression collection channel 310*a* formed on an outer circumferential surface of the mainframe 310 and a fixed compression collection channel 320*a* formed on an outer circumferential surface of the fixed scroll 320. The first compression collection channel 310*a* and the second compression collection channel 320*a* may have the same cross-sectional shape.

In other words, the drive portion 200 may include a plurality of drive collection channels 201 recessed in the outer circumferential surface such that a fluid including at least one of refrigerant or the oil may pass along the channels. Further, the compression portion 300 may include a plurality of compression collection channels 301, which are recessed at positions corresponding to the drive collection channels and in the outer circumferential surface thereof such that a fluid including at least one of refrigerant or the oil may pass along the channels.

The drive collection channel 201 and the compression collection channel 301 may be partially overlapped so that the oil flow is not blocked when the oil moves along the inner wall of the casing 100.

Specifically, the plurality of drive collection channels 201 may include at least one first drive collection channel 201*a* having the same width as that of the compression collection channel 301.

Further, the plurality of drive collection channels 201 may include at least one second drive collection channel 201*a* having a different width from that of the compression collection channel 301.

In this connection, the first drive collection channel 201*a* and the compression collection channel 301 may have the same cross-sectional shape, while the second drive collection channel 201*b* may be provided in a cross sectional shape different from that of the compression collection channel 301.

In one example, the second drive collection channel 201*b* may have the entirety in the direction parallel to the rotatable shaft direction of the drive portion 200 having a different cross-section than that of the compression collection channel 301. In another example, the second drive collection channel 201*b* may have a portion thereof in the direction parallel to the rotatable shaft direction of the drive portion 200 having a different cross-section than that of the compression collection channel 301. For example, a first partial region extending from one end to the other end of the second drive collection channel 201*b* may be the same as the compression collection channel 301 in terms of the cross-section shape, while a second partial region extending from the first partial region to the other end may be configured to be different or smaller than the compression collection channel 301 in terms of the shape or size of the cross section.

In other words, the second drive collection channel 201*b* may be formed to be at least partially different from the compression collection channel 301 in terms of the shape of the cross section or may be formed to be at least partially smaller than the compression collection channel 301 in terms of the size of the cross section.

Thus, the first drive collection channel 201*a* and the compression collection channel 301 may have the same width or may have the same sectional shape. The second drive collection channel 201*b* and the compression collection channel 301 may have different widths or different sectional shapes.

Referring to FIG. 6*b*, the collection channel may include one or more first combined channel I formed by the first drive collection channel 201*a* and the compression collection channel 301 and one or more second combined channel II formed by the second drive collection channel 201*b* and the compression collection channel 302.

As such, the fastening member may be detachably coupled to the first combined channel I or detachably coupled to the second combined channel II.

Specifically, when the fastening member 600 is simultaneously detachably coupled to the first drive collection channel 201*a* and the compression channel 301, the problem that the drive portion 200 and the compression portion 300 may be rotated in a combined state or the rotatable shaft 230 may move radially or be misaligned with each other radially may be avoided.

Further, the fastening member 600 is detachably coupled to the compression collection channel 301, and supports the cross section of the second drive collection channel 201*b*, the drive portion 200 and the compression portion 300 may be prevented from moving in the longitudinal direction of the rotatable shaft 230 or may be prevented from varying in spacing therebetween.

In particular, when the drive portion 200 and the compression portion 300 are configured in the vertical direction, the free end of the fastening member 600 may support the second drive collection channel 201*b* to prevent the gap therebetween from narrowing.

In this connection, the fastening member 600 has the same width as that of the first drive collection channel 201*a* and that of the compression collection channel 301, such that the first drive collection channel 201*a* and the compression collection channel 301 may be constrained in moment by the fastening member 600.

Further, the fastening member 600 may be configured to correspond to the first drive collection channel 201*a* and the compression collection channel 301 in terms of a cross-sectional area thereof.

That is, the first drive collection channel 201*a* and the compression collection channel 301 to which the fastening member 600 is detachably coupled at the same time may be configured to have the widths equal to each other, or may have the same cross section shapes.

FIG. 6 illustrates that the drive collection channel 201 includes the first drive collection channel 201*a* having the same sectional area as the compression collection channel 301 and the second drive collection channel 201*b* having a different sectional area from that of the compression collection channel 301. However, the disclosure is not limited thereto. It is not excluded that the shape of the cross section of the compression collection channel 301 is configured differently from that of the drive collection channel 201.

Figure 7:
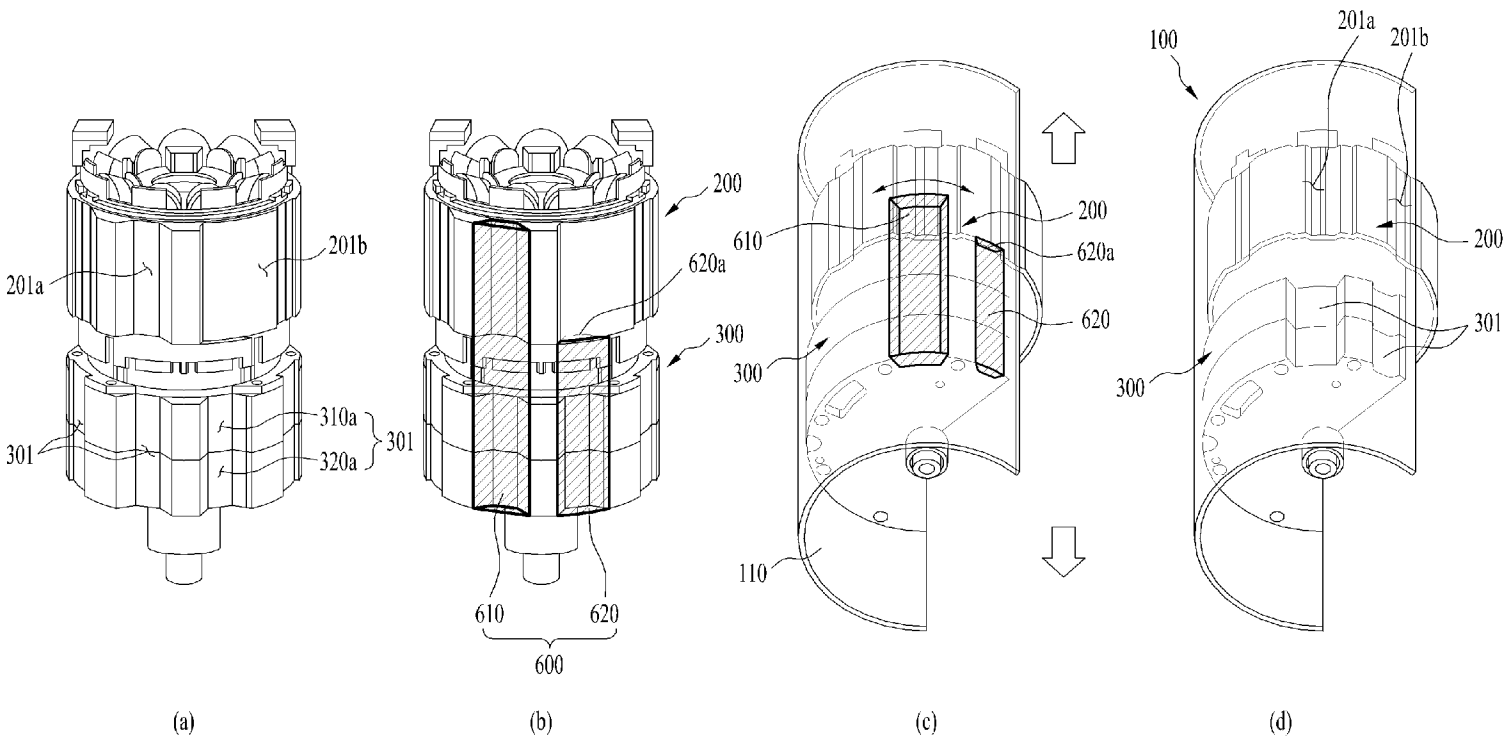
FIG. 7 illustrates one embodiment of a method for manufacturing the compressor apparatus in accordance with the present disclosure.

FIG. 7 illustrates one embodiment in which the fastening member 600 fixes the location of the compression portion 300 and the drive portion 200 using the collection channel.

Referring to FIG. 7*a*, the compression portion 300 and the drive portion 200 are combined with each other so that the drive collection channel 201 and the compression collection channel 301 correspond to each other.

Referring to FIG. 7*b*, the fastening member 600 is detachably coupled to the collection channels.

The fastening member 600 includes a first fastening member 610 detachably coupled to the first drive collection channel 201*a* and the compression collection channel 301 at the same time, and a second fastening member 620 configured to be detachably coupled to one of the second drive collection channel 201 and the compression collection channel 301 and to support the other of the compression collection channel 201 and the drive collection channel 301.

The first fastening member may be embodied as a fastening jig 610, while the second fastening member may be embodied as a support jig 620.

The fastening jig 610 is detachably coupled to a portion corresponding to the compression collection channel 301 and the first drive collection channel 201*a*.

Thus, the fastening jig 610 is removably coupled to both the drive portion 200 and the side faces of the compression portion 300 to support the drive portion 200 and the compression portion 300.

Further, the support jig 620 is detachably coupled to the corresponding one of the compression collection channel 301 and the second drive collection channel 201*b*. As such, the support jig 620 is coupled to the side face of one of the drive portion 200 and the compression portion 300 to support the other thereof. That is, the spacing between the drive portion 200 and the compression portion 300 may be maintained by the support jig 620.

In other words, the fastening jig having a rod shape may be detachably inserted and mounted in the region where the drive collection channel 201 and the compression collection channel 301 are overlapped with each other.

As described above, in order to prevent the compression portion 300 and the drive portion 200 from being misaligned with each other or rotating in the radial direction, the drive collection channel 201 and the compression collection channel 301 have the same width, and the fastening jig 610 may be provided to have a width corresponding to the width of each of the collection channels. Furthermore, the drive collection channel 201 and the compression collection channel 301 may be configured to have the same shape in the cross section, while the fastening jig may be provided to have a shape corresponding to the shape of each of the collection channels.

When the fastening jig face-touches both the side faces of the drive collection channel 201 and the compression collection channel 301 and the gaps therebetween do not exist, the drive portion 200 or the compression portion 300 may be prevented from being misaligned with each other or rotating.

As a result, the fastening jig may be detachably coupled to at least portion of the first combined channels I and may be inserted into the receiving shell 110.

In one example, the spacing between the compression portion 300 and the drive portion 200 needs to be maintained. In this connection, the compression portion 300 and the drive portion 200 may easily move close to each other due to their own weights and may not be separated from each other.

The support jig 620 may be coupled to the side face of the compression portion 300 to support one face or the bottom of the drive portion 200 or may be coupled to the side face of the drive portion 200 to support one face or top of the compression portion 300.

Thus, the support jig 620 may be configured to be coupled to the compression collection channel to support the drive portion 200, or be coupled to the fixed collection channel to support the compression portion 300.

As described above, since the fixed collection channel 201 and the compression collection channel 301 are essentially provided at positions corresponding to each other due to the structure thereof, at least one of the fixed collection channels 201 may have a different cross-sectional area than that of the compression collection channel 301.

In other words, the fixed collection channel 201 may include a second fixed collection channel 201*b* having a smaller cross-sectional area than that of the compression collection channel 301 or a smaller width than that of the compression collection channel 301.

Thus, the second fixed collection channel 201*b* protrudes from the compression collection channel 301 in a direction parallel to the length of the rotatable shaft 230, thereby to provide a portion thereof which the free end of the support jig may contact.

In other words, the collection channel may include at least one second combined channel II composed of the compression collection channel 301 and the second fixed collection channel 201*b* overlapping each other.

The support jig is detachably coupled to at least one of the second combined channels II to support at least one of the drive portion 200 and the compression portion 300 and is inserted into the casing 100.

As a result, the first combined channel I is composed of the fixed collection channel 201 and the compression collection channel 301 which have the same areas or are not overlapped with each other. The fastening jig may be inserted into the first combined channel I. The second combined channel II is composed of the fixed collection channel 201 and the compression collection channel 301 which are different from each other in the area and overlap with each other. The support jig may be inserted into only one of the compression portion 300 and the drive portion 200.

Referring to FIG. 7*c*, the drive portion 200 and the compression portion 300 are inserted in and secured to the receiving shell 110 while the fastening jig and the supporting jig are coupled to the drive portion 200 and the compression portion 300.

Referring to FIG. 7*d*, when the drive portion 200 and the compression portion 300 have been coupled to the receiving shell 110, the jigs may be removed from the drive portion 200 and the compression portion 300. Thus, the assembly of the compressor apparatus 10 may be completed.

As a result, the compression portion 300 and the drive portion 200 may be constructed to be inserted into the casing 100 while they are coupled to the fastening member 600.

Figure 8:
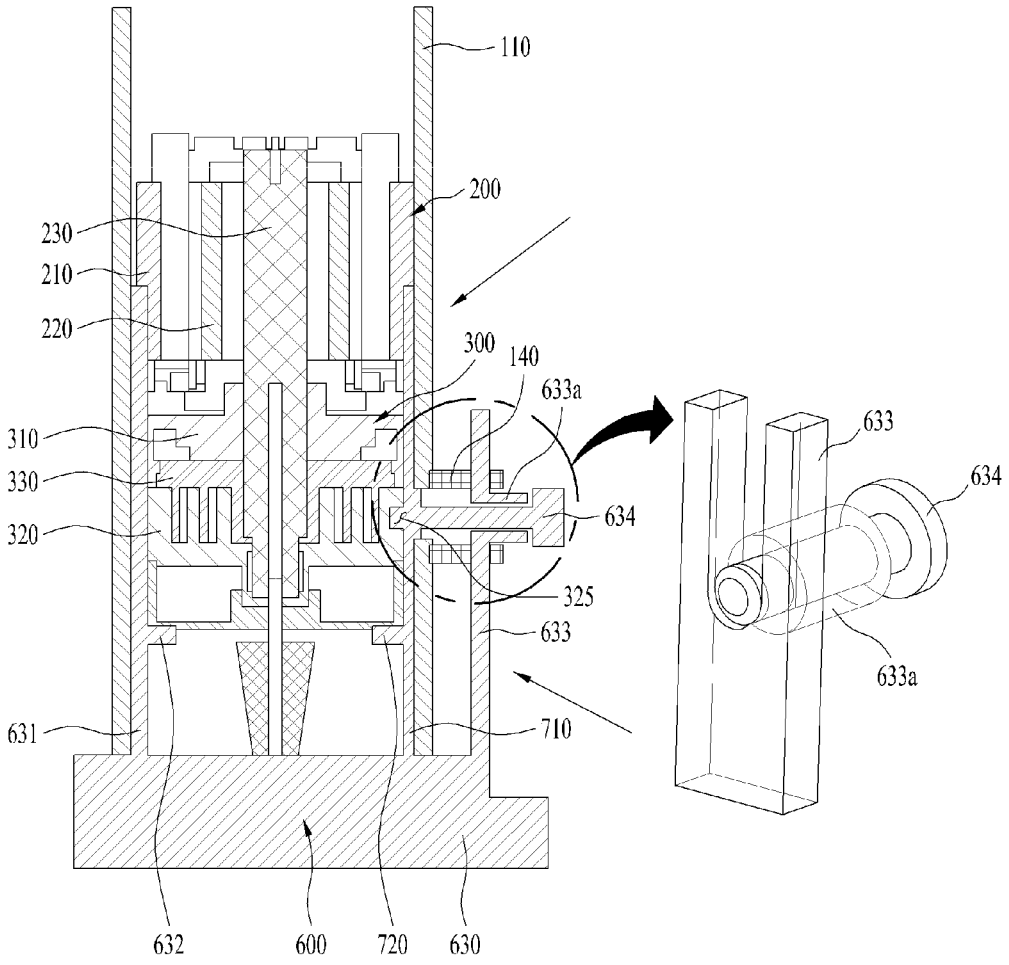
FIG. 8 shows another embodiment of a method for manufacturing the compressor apparatus in accordance with the present disclosure.

FIG. 8 shows another embodiment in which the compression portion 300 and the drive portion 200 are installed simultaneously into the casing 100.

In the compressor apparatus 10 in accordance with the present disclosure, the drive portion 200 and the compression portion 300 may be installed while the receiving shell 110 is seated on the fastening member 600.

The fastening member 600 may be constructed such that the fastening member 600 are coupled to the fastening member 600 when the compression portion 300 and the drive portion 200 are inserted into the casing 100. The fastening member 600 may include a mounting body 630 that supports the bottom of the casing 100 or the receiving shell 110, an hollow inserted portion 631 extending from the mounting body 630 and inserted in the receiving shell 110 to contact the inner circumferential surface of the receiving shell 110, and a seat 632 extending from the hollow inserted portion 631 toward the interior and defining a seating position of the drive portion 200 and the compression portion 300.

While the receiving shell 110 is fitted with the hollow inserted portion 631 and supported thereon, the drive portion 200 and the compression portion 300 are inserted into the receiving shell 110 and then seated on the seat 632. As a result, when the drive portion 200 and the compression portion 300 are simply inserted into the receiving shell 110, the mounted positions thereof may be automatically determined.

The hollow inserted portion 631 has a shape corresponding to the drive collection channel 201 and the compression collection channel 301 and thus may be inserted into both the drive collection channel 201 and the compression collection channel 301. This prevents the compression portion 300 and the drive portion 200 from being distorted.

In this connection, the drive collection channel 201 may be at least partially different from the compression collection channel 301 in terms of the cross-section, such that the drive collection channel 201 supports the upper end of the hollow inserted portion 631.

Accordingly, the hollow inserted portion 631 may be inserted into the first combined channel I and the second combined channel II to fix the position of the drive portion 200 and the compression portion 300.

The hollow inserted portion 631 may have the width equal to that of the first combined channel I and the second combined channel II or may have a shape corresponding to the cross section of each of the first combined channel I and the second combined channel II.

As a result, the mount 700 allows the drive portion 200 and the compression portion 300 to be coupled to the receiving shell 110 while misalignment or spacing differences therebetween is suppressed even when the welding process is omitted.

In one example, during the heating and shrinking of the receiving shell 110, the refrigerant supply pipe 140 coupled to the receiving shell 110 and the inflow hole 325 of the fixed scroll 320 may be misaligned with each other.

To prevent this situation, the fastening member 600 may further include an extension 633 extending from the mounting body 630 outwardly of the hollow inserted portion 631 and a fixed pin 634 fixed to the extension 633.

The extension 633 may have an auxiliary hole or auxiliary slit at a location corresponding to the refrigerant supply pipe 140.

In one example, the extension 633 may include an auxiliary rod 633*a* to tightly secure the fixed pin 634 to the refrigerant supply pipe 140. The auxiliary rod 633*a* may be provided in a pipe shape extending outward from the auxiliary hole of the extension 633.

Thus, the fixed pin 634 may be inserted into the refrigerant inlet tube 140 through the auxiliary hole or auxiliary slit of the extension 633 and may be detachably coupled into the inflow hole 325 formed in the fixed scroll 320 of the compression portion 300.

As a result, when the casing 100 is heated to thermally expand and then cooled and thermally shrunk, the position of the compression portion 300 and the casing 100 may be fixed to a proper position where the refrigerant is properly introduced.

Figure 9:
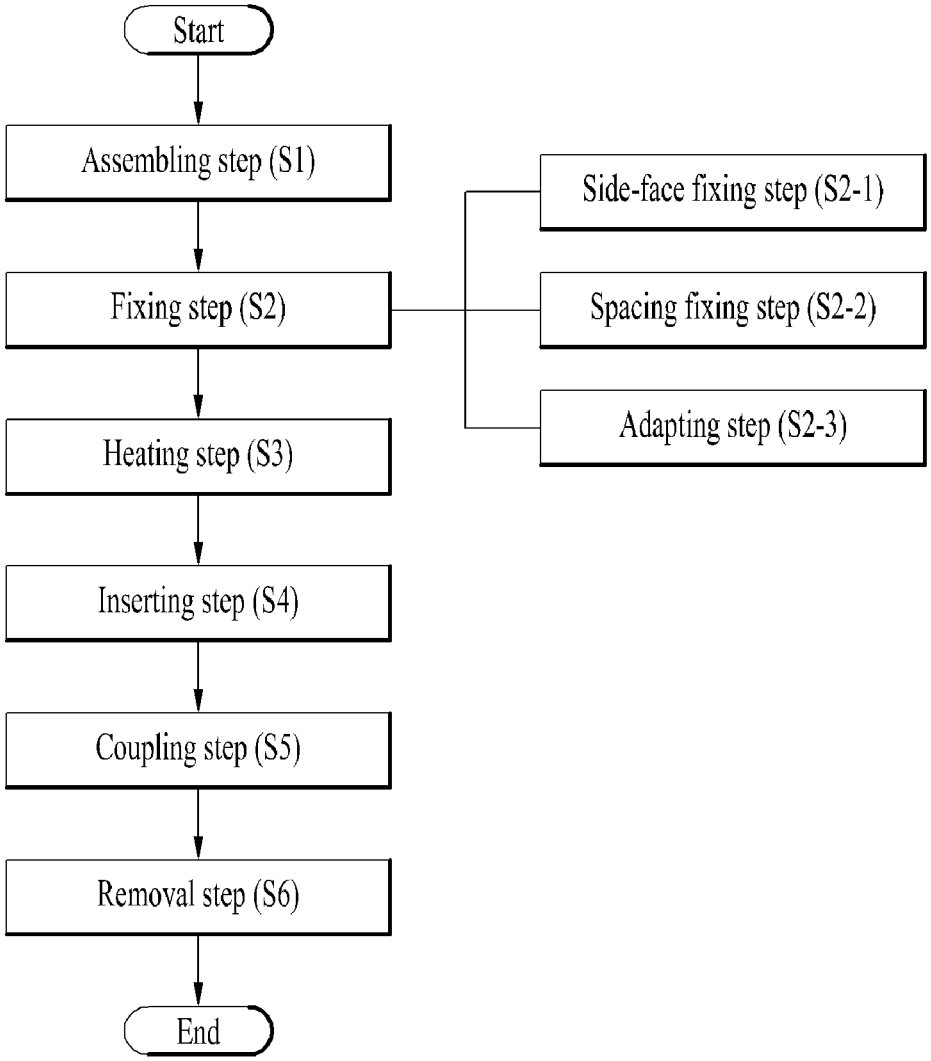
FIG. 9 shows a flow chart of the method for manufacturing the compressor apparatus in accordance with the present disclosure.

FIG. 9 shows a flow chart of the method for manufacturing the compressor apparatus in accordance with the present disclosure.

The method of manufacturing the compressor apparatus in accordance with the present disclosure may include an assembling step s1 for coupling the compression portion 300 and the drive portion 200 to each other outside the casing 100, an inserting step s4 to insert the compression portion 300 and the drive portion 200 together into the casing 100, and a coupling step s5 for coupling the compression portion 300 and the drive portion 200 to the casing 100.

As a result, the drive portion 200 and the compression portion 300 may be assembled with each other in an optimal designed state while the assembly process is not subjected to the space limitation in the casing 100. The optimal state may then be maintained by coupling the drive portion 200 and the compression portion 300 together into the casing 100.

In one example, before the inserting step s4, the method may include a heating stage s3 for heating the casing 100 to allow the drive portion 200 and the compression portion 300 to be inserted easily into the casing.

Further, the coupling step S4 may be a step of cooling the casing 100 and thermally shrinking the casing while the drive portion 200 and the compression portion 300 are inserted into the casing 100.

Thus, in the processing of producing the compressor apparatus 10, the drive portion 200 and the compression portion 300 may be coupled to the casing 100 without a welding process.

The method may further include a fixing step s2 by which the compression portion 300 and the drive portion 200 are fastened to the fastening member 600 such that the compression portion 300 and the drive portion 200 are not rotated or are disallowed to move in the radial direction of the rotatable shaft or to move in the longitudinal direction of the rotatable shaft 230.

The fixing step s2 may be performed before the inserting step s4 such that the compression portion 300 and the drive portion 200 may be pushed into the casing 100 with the optimal fixed position.

For example, the fixing step s2 may be the step of combining the side face of each of the drive portion 200 and the compression portion 300 to the fastening member such as a separate jig.

The fixing step s2 may include a side face fixing step s2-1 for fixing the outer circumferential surface of the compression portion 300 and the outer circumferential surface of the drive portion 200 to the fastening member 600 and a spacing fixing step s2-2 to secure the outer circumferential surface of one of the compressor and driver and one end face of the other thereof to the fastening member 600.

The side face fixing step S2-1 may be a step of detachably coupling the outer circumferential surface of the compression portion 300 and the outer circumferential surface of the drive portion 200 to the fastening jig 610.

The spacing fixing step S2-2 may be a step of detachably coupling the support jig 620 to the outer circumferential surface of the compression portion 300 such that the free end of the support jig is in contact with one end of the drive portion 200 and supports the drive portion 200.

In one example, the fixing step s2 may further include an adapting step S2-3 to fix a refrigerant inflow pipe in communication with the casing and fix the inflow hole of the compressor.

The adapting step s2-3 may be to fix the refrigerant supply pipe 140 of the casing 100 and the inflow hole 325 of the fixed scroll 320 to the fixed pin 634 in the heating step s3 and the coupling step s5.

In the adapting step s2-3, the axis of each of the fixed scroll 320 and the casing 100 may be adjusted in the radial direction of the casing 100.

In one example, the fixing step s2 may be performed after the inserting step s4. That is, when the casing 100 and the compression portion 300 are inserted into the casing 100 while the casing 100 is mounted on the mounting body 630, the position of the drive portion 200 and the compression portion 300 may be fixed by the hollow inserted portion 631 and the seat 632.

The method for manufacturing the compressor apparatus may further include a removal step s5 for separating the fastening member 600 from the casing 100.

In the elimination step s5, when the casing 100 is combined with the drive portion 200 and the compression portion 300 via cooling or the like, the fastening jig 610, the support jig 620, or the mounting body 630 may be removed from the casing, the driver and compressor.

The present disclosure may be embodied in various forms without departing from the scope of the invention. Therefore, when the modified embodiment includes the components of the present disclosure, it should be regarded as belonging to the scope of the present disclosure.

The invention claimed is:

1. A compressor apparatus comprising:

a casing; and a driver coupled to the casing and configured to rotate a rotatable shaft;

a compression portion coupled to the rotatable shaft and configured to compress fluid;

a plurality of drive collection channels defined at an outer circumferential surface of the driver and configured to allow fluid to pass therealong;

a plurality of compression collection channels defined at an outer circumferential surface of the compression portion and positioned to correspond to the plurality of drive collection channels, the plurality of compression collection channels being configured to allow fluid to pass therealong; and at least one of a first fastener or a second fastener, the first fastener configured to be detachably coupled to at least one of the plurality of drive collection channels and at least one of the plurality of compression collection channels to thereby fix the driver to the compression portion, the second fastener configured to be detachably coupled to at least one of the plurality of drive collection channels or at least one of the plurality of compression collection channels to thereby fix the driver to the compression portion , wherein the driver and the compression portion that are fixed to each other by the at least one of the first fastener or the second fastener are coupled to the casing.

2. The compressor apparatus of claim 1, wherein the plurality of drive collection channels have a same width as the plurality of compression collection channels.

3. The compressor apparatus of claim 2, wherein the plurality of drive collection channel and the plurality of compression collection channels have a same cross- sectional shape as a cross-sectional shape of the first fastener.

4. The compressor apparatus of claim 1, wherein at least one of the plurality of compression collection channels has a different cross-sectional shape from at least one of the plurality of drive collection channels.

5. The compressor apparatus of claim 4, wherein at least a portion of the at least one of the plurality of drive collection channels has a cross-sectional area that is smaller than a cross-sectional area of the at least one of the plurality of compression collection channels.

6. The compressor apparatus of claim 1, wherein the compression portion and the driver simultaneously contact the casing based on the compression portion and the driver being inserted into the casing.

7. The compressor apparatus of claim 1, wherein the compression portion and the driver are configured to be separated from the at least one of the first fastener or the second fastener based on the compression portion and the driver being coupled to the casing.

8. The compressor apparatus of claim 1, wherein the compression portion and the driver are configured to, based on the compression portion and the driver being inserted into the casing, be coupled to the at least one of the first fastener or the second fastener.

9. The compressor apparatus of claim 8, wherein the first fastener includes:

a mounting body configured to be mounted to one end of the casing;

an inserted portion extending from the mounting body and configured to be inserted into the casing; and a seat extending from the inserted portion and defining a mounting position of at least one of the driver or the compression portion.

10. The compressor apparatus of claim 9, wherein the first fastener further includes:

an extension extending from the mounting body toward a refrigerant inflow pipe that is coupled to the casing; and a fixed pin extending from the extension and configured to be inserted into the refrigerant inflow pipe and detachably coupled to the compression portion.

11. The compressor apparatus of claim 1, wherein the plurality of drive collection channels are partially recessed at the outer circumferential surface of the driver.

12. The compressor apparatus of claim 11, wherein the plurality of compression collection channels are partially recessed at the outer circumferential surface of the compression portion.

13. A method for manufacturing a compressor apparatus, wherein the apparatus includes:

a casing;

a driver coupled to the casing and configured to rotate a rotatable shaft; and a compression portion coupled to the rotatable shaft and disposed within the casing, the compression portion being configured to compress fluid, wherein the method comprises:

assembling the compression portion with the driver outside the casing, inserting an assembly of the compression portion and the driver into the casing, coupling the assembly of the compression portion and the driver to the casing, and coupling a fastener to the compression portion and the driver, the fastener configured to restrict rotation of at least one of the compression portion or the driver, the fastener configured to restrict movement of at least one of the compression portion or the driver in a radial direction of the rotatable shaft or movement of at least one of the compression portion or the driver in a longitudinal direction of the rotatable shaft, the fastener configured to be coupled to at least one of an outer circumferential surface of the compression portion or an outer circumferential surface of the driver.

14. The method of claim 13, wherein the fastener is configured to be coupled to the outer circumferential surface of the compression portion and the outer circumferential surface of the driver.

15. The method of claim 13, wherein coupling the fastener to the compression portion and the driver includes:

fixing the fastener to the outer circumferential surface of the compression portion and the outer circumferential surface of the driver; and fixing the fastener to (i) the outer circumferential surface of one of the compression portion and the driver and (ii) an end face of the other of the compression portion and the driver.

16. The method of claim 15, wherein coupling the fastener to the compression portion and the driver includes:

fixing a refrigerant inflow pipe in fluid communication with the casing, and fixing an inflow hole of the compression portion to the fastener.

17. The method of claim 16, wherein the fastener includes:

a mounting body configured to be mounted to one end of the casing;

an inserted portion extending from the mounting body and configured to be inserted into the casing; and a seat extending from the inserted portion and defining a mounting position of at least one of the driver or the compression portion.

18. The method of claim 17, wherein the fastener further includes:

an extension extending from the mounting body toward the refrigerant inflow pipe that is coupled to the casing; and a fixed pin extending from the extension and configured to be inserted into the refrigerant inflow pipe and detachably coupled to the compression portion.

19. The method of claim 18, wherein fixing the inflow hole of the compression portion to the fastener includes:

fixing the inflow hole of the compression portion to the fixed pin of the fastener.

20. The method of claim 13, further comprising:

separating the fastener from the casing.

* * * * *